US009719762B2

(12) United States Patent
Langenbeck

(10) Patent No.: US 9,719,762 B2
(45) Date of Patent: Aug. 1, 2017

(54) CARTRIDGES AND BULLETS

(71) Applicant: Keith A. Langenbeck, Keller, TX (US)

(72) Inventor: Keith A. Langenbeck, Keller, TX (US)

( * ) Notice: Subject to any disclaimer, the term of this patent is extended or adjusted under 35 U.S.C. 154(b) by 118 days.

(21) Appl. No.: 14/676,792

(22) Filed: Apr. 1, 2015

(65) Prior Publication Data

US 2016/0290774 A1 Oct. 6, 2016

(51) Int. Cl.

| | |
|---|---|
| ***F42B 10/00*** | (2006.01) |
| ***F42B 12/00*** | (2006.01) |
| ***F42B 30/00*** | (2006.01) |
| ***F42B 30/02*** | (2006.01) |
| ***F42B 5/02*** | (2006.01) |

(52) U.S. Cl.

CPC ..... *F42B 30/02* (2013.01); *F42B 5/025* (2013.01)

(58) Field of Classification Search

CPC ..... F42B 30/02; F42B 5/02
USPC ..... 102/439
See application file for complete search history.

(56) References Cited

U.S. PATENT DOCUMENTS 4,517,897 A * 5/1985 Kneubuhl ..... B21K 1/025 102/439
4,517,898 A * 5/1985 Davis ..... F42B 5/025 102/514
4,708,063 A * 11/1987 Ladriere ..... F42B 30/02 102/516
5,058,503 A * 10/1991 Adams, III ..... F42B 30/08 102/439
5,092,246 A * 3/1992 Huerta ..... F42B 12/08 102/439
5,239,928 A * 8/1993 Ricci ..... F42B 5/067 102/430
5,275,110 A * 1/1994 Flatau ..... F42B 30/02 102/503
5,796,031 A * 8/1998 Sigler ..... F42B 7/02 102/438
6,070,532 A * 6/2000 Halverson ..... F42B 30/02 102/501
6,105,506 A * 8/2000 Gangale ..... F42B 10/26 102/439
7,278,358 B2 * 10/2007 Huffman ..... F42B 12/40 102/439
7,302,891 B1 * 12/2007 Adams ..... F42B 5/025 102/439
7,380,502 B2 * 6/2008 Emary ..... F42B 12/34 102/506

(Continued)

*Primary Examiner* — Samir Abdosh
(74) *Attorney, Agent, or Firm* — Lyman Moulton, Esq.

(57) ABSTRACT

An improved bullet disclosed includes a blend radius disposed between a first tangent thereof intersecting a shank of the bullet and a second tangent thereof intersecting one of a cone ogive and a boattail ogive of the bullet. The bullet also includes at least one dimple formed into a base of the bullet adjacent the boattail ogive, a curved segment joining the dimpled base and the boattail cone and a truncated cone ogive with a meplat end and a shank end, the truncated cone ogive adapted to produce less drag and friction in air than a secant or a tangent ogive. The improved bullet extends an effective flight range and a Coanda effect there around reducing air turbulence and drag on the bullet in flight. A cartridge adapted to receive the improved bullet is necked down and shortened for a COAL (cartridge overall length) nominally the same as conventional cartridges.

14 Claims, 9 Drawing Sheets

(56) References Cited

U.S. PATENT DOCUMENTS

| | | | | |
|---|---|---|---|---|
| 7,455,015 | B2 * | 11/2008 | Krstic | F42B 12/74<br>102/439 |
| 2007/0000404 | A1 * | 1/2007 | Eberhart | F42B 12/78<br>102/516 |
| 2011/0088537 | A1 * | 4/2011 | Eberhart | F42B 12/74<br>86/55 |
| 2011/0107937 | A1 * | 5/2011 | Thompson | F42B 12/74<br>102/517 |
| 2011/0252997 | A1 * | 10/2011 | Hoffman | F42B 12/06<br>102/439 |
| 2014/0230680 | A1 * | 8/2014 | Meller | F42B 12/34<br>102/439 |

* cited by examiner

CARTRIDGES AND BULLETS

BACKGROUND OF THE INVENTION

The field of aerodynamic design for projectiles, aircraft, rockets and the like is extensive. The physical size of small caliber bullets/projectiles presents challenges not encountered in aircraft wing, ballistic missile, artillery shell or aircraft delivered bomb design. For small caliber weapons like handguns, shotguns, rifles and machine guns, performance enhancements have for decades been incremental at best.

The search for improved performance in handgun cartridges with better bullet external balistics and terminal effects continues unabated. It is not uncommon for Law Enforcement organizations to have issued 9 mm Luger/Parabellum (9×19 mm) semi-automatic duty pistols in the 1990's only to change to 40 Smith & Wesson caliber (10×22 mm) in the 2000's and now are reverting back to the 9 mm Luger. The reasons for changing back to the 9 mm from the 40 S&W include:

- advances in 9 mm bullet design,
- increased muzzle energy in +P loadings,
- reduced recoil versus 40 S&W, 357 SIG and 45 ACP
- longer service life of the weapon,
- quicker and more accurate follow up shots due to reduced recoil,
- lower cost ammunition and others.

Another distinct advantage of the 9 mm Luger is its smaller case diameter, which results in greater magazine capacity versus similar sized pistols chambered in 40 S&W (based on the 10 mm Auto case dimensions), 357 SIG (Schweizerische Industrie-Gesellschaft, also based on the 10 mm Auto case dimensions), 10 mm Auto, 38 Super (semi-rimmed case) and 45 ACP (Automatic Colt Pistol) pistols. Recent reports from the FBI (Federal Bureau of Investigation) affirm that the terminal effects and wound damage for modern 9 mm Luger cartridges/bullets versus 40 S&W and 45 ACP are essentially the same.

The 9 mm Luger is considered to be the most popular centerfire pistol cartridge in the world. The 9 mm Luger, aka 9 mm NATO (North Atlantic Treaty Organization), is the standard center fire pistol cartridge for the US military and its NATO allies. However during the summer of 2014, the US Army announced a new pistol procurement program known as the Modular Handgun System. The program intends not only to replace approximately 400,000 Beretta M9 and SIG Sauer M11 pistols, but is seeking alternative cartridges to the 9 mm NATO.

Different than Law Enforcement engagements, the military can frequently encounter soft body armor or thick clothing that the 9 mm Luger fails to effectively penetrate. Spokesmen for the Modular Handgun Caliber procurement have stated that the replacement caliber " . . . must exceed the performance of the current M882 9 mm round." and " . . . provide the soldier with increased terminal performance," and "feedback from soldiers in the field is that they want increased 'knock-down power."

The difference in ballistic efficiency for the same projectile diameter used in common handguns and rifles is vast. Handgun projectiles are typically designed for close range and rifles for more distant targets. The different applications affect the overall size of the weapon, bullet shape, bullet diameter, bullet length, cartridge overall length, magazine capacity and projectile performance. For example, common 30 caliber bullets for handguns have a diameter from 0.309 to 0.312 inches, weigh from 80 to 110 grains and have ballistic coefficients of around 0.100 to 0.150.

Common 30 caliber bullets for rifles have a diameter from 0.303 to 0.311 inches, weigh from 110 to 220 grains and have ballistic coefficients of around 0.250 to 0.450. The lower the ballistic coefficient, the quicker the bullet loses velocity and useful range. Nose profile or shape, ratio of bullet length to diameter, shape of the end of the projectile and other design aspects significantly affect the ballistic coefficient. Typically handgun bullets are larger in diameter than rifle bullets. The 30 caliber cartridges best illustrate the performance variations between handgun and rifle bullets of the same nominal diameter.

The Tokarev handgun cartridge from the Soviet Union, also known as the 7.62×25 mm, commonly has a bullet diameter of 0.309 inches, bullet length of 0.52 inches for a 90 grain weight, case diameter of 0.387 inches, cartridge overall length of 1.34 inches, muzzle velocity of 1400-1700 feet per second from a 4.5 inch barrel, ballistic coefficient of 0.142 and an effective range to 50 meters+/−. The well-known rifle cartridge .308 Winchester, also known as 7.62×51 mm NATO, commonly has a bullet diameter of 0.308 inches, bullet length of 1.15 inches for a 165 grain weight, case diameter of 0.470 inches, cartridge overall length of 2.81 inches, muzzle velocity of 2600-2800 feet per second from a 20 inch barrel, ballistic coefficient of 0.450 and an effective range of 800 meters+/−.

Trying to use lighter weight rifle bullets in a pistol application like the Tokarev results in functional compromises or are simply unworkable. Properly seating a tapered nose, longer bullet can extend the cartridge overall length beyond the physical constraints of the magazine and the breech or cannibalize case capacity for the propellant needed to move the bullet at desired velocities.

SUMMARY OF THE INVENTION

An improved pistol bullet disclosed includes a blend radius disposed between a first tangent thereof intersecting a shank of the bullet and a second tangent thereof intersecting one of a cone ogive and a boattail ogive of the bullet. Therefore a dual tangent blend radius is configured to extend an effective flight range and a Coanda effect there around reducing air turbulence and drag on the bullet in flight. The improved pistol bullet also includes at least one dimple formed into a base of the bullet adjacent the boattail, the dimple adapted to effect a Coanda air flow around the base and reduce a turbulence and a drag on the bullet in flight. The improved pistol bullet additionally includes a curved segment joining the dimpled base and the boattail cone, the curved segment configured to effect a Coanda air flow across the curved segment. The improved pistol bullet further includes a truncated cone ogive with a meplat end and a shank end, the truncated cone ogive adapted to produce less drag and friction in air than a secant or a tangent ogive.

An improved pistol bullet and cartridge system includes an improved pistol bullet comprising a blend radius disposed between a first tangent thereof across a shank of the bullet and a second tangent thereof across one of a cone ogive and a boattail cone of the bullet. The system also includes a cartridge adapted to receive the improved pistol bullet, the cartridge configured to be necked down and shortened for a COAL (Cartridge Over All Length) that is nominally the same as conventional cartridges.

Other aspects and advantages of embodiments of the disclosure will become apparent from the following detailed description, taken in conjunction with the accompanying drawings, illustrated by way of example of the principles of the disclosure.

Figure 1:
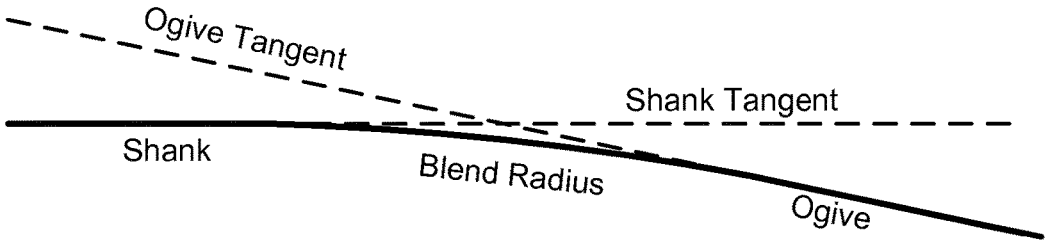
FIG. 1 depicts a close up pictorial view of a dual tangent blend radius at the intersection of the cone ogive to the shank on an improved pistol bullet in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

This application discloses novel and unobvious improvements to projectile performance and launch systems in small caliber weapons but the features and performance benefits could be applied to large caliber projectiles as well. Throughout the present disclosure and continuances and/or divisional disclosures thereof, the terms 'slug,' 'bullet,' and 'projectile' may be used interchangeably to generally define a solid mass expelled from a firearm, usually explosively. The term 'nominal' used throughout may define a measurement or a metric near a mean in a normal distribution. Furthermore, the term 'plateau' used in the present disclosure refers to a conventional definition thereof meaning a relatively level surface considerably raised above adjoining surfaces.

FIG. 1 depicts a close up pictorial view of a dual tangent blend radius at the intersection of the cone ogive to the shank on an improved pistol bullet in accordance with an embodiment of the present disclosure. A blend radius is disposed between a first tangent thereof intersecting a shank of the bullet and a second tangent thereof intersecting a cone ogive.

Figure 2:
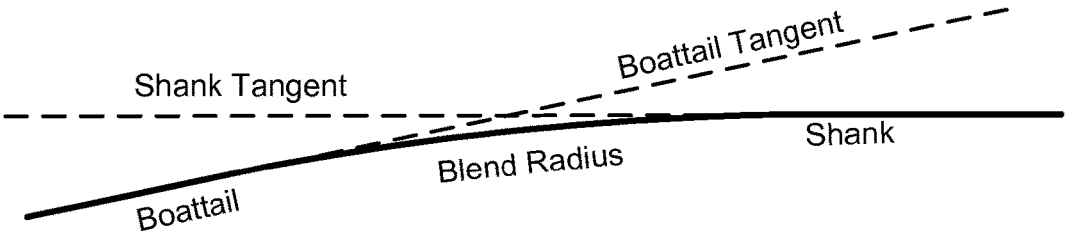
FIG. 2 depicts a close up pictorial view of a dual tangent blend radius at the intersection of the shank to the boattail on an improved pistol bullet in accordance with an embodiment of the present disclosure.

FIG. 2 depicts a close up pictorial view of a dual tangent blend radius at the intersection of the shank to the boattail on an improved pistol bullet in accordance with an embodiment of the present disclosure. Therefore a dual tangent blend radius is configured to extend an effective flight range and a Coanda effect there around reducing air turbulence and drag on the bullet in flight.

Figure 3:
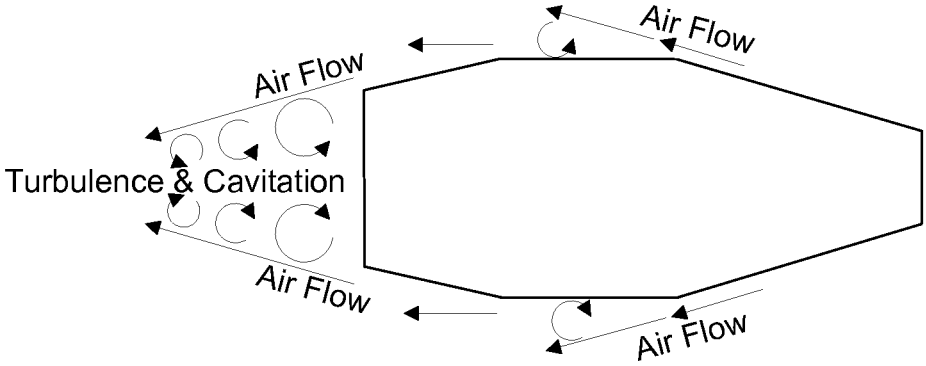
FIG. 3 depicts the cavitation and turbulent air flow around the cone, shank and base end of a conventional bullet.

FIG. 3 depicts the cavitation and turbulent air flow around the cone, shank, boattail and base end of a conventional bullet. The cavitation and turbulence are set up at sharp transitions of one surface to another and slow the bullet down and decrease its effective range, as compared to the disclosed improved bullet.

Figure 4:
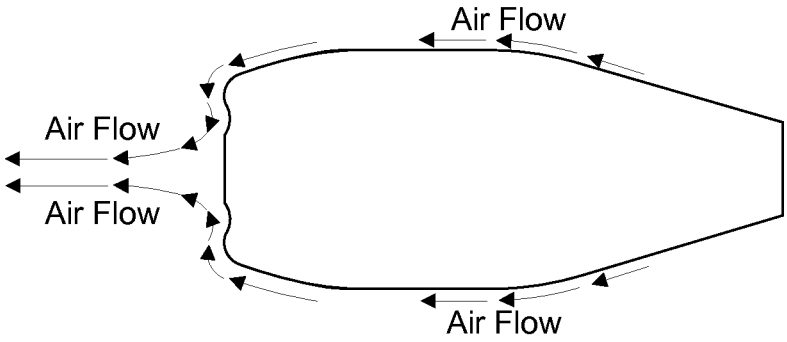
FIG. 4 depicts the Coanda effect air flow around the ogive cone, shank, boattail and dimpled base end of an improved pistol bullet in accordance with an embodiment of the present disclosure.

FIG. 4 depicts the Coanda effect air flow around the ogive cone, shank, boattail and dimpled base end of an improved pistol bullet in accordance with an embodiment of the present disclosure. The Coanda effect design acts to reduce the wake turbulence by folding the air around the base of the bullet, collapsing or closing the diameter of the air disturbance and turbulence after the bullet base, as if the boattail cone of the bullet was much longer.

Figure 5:
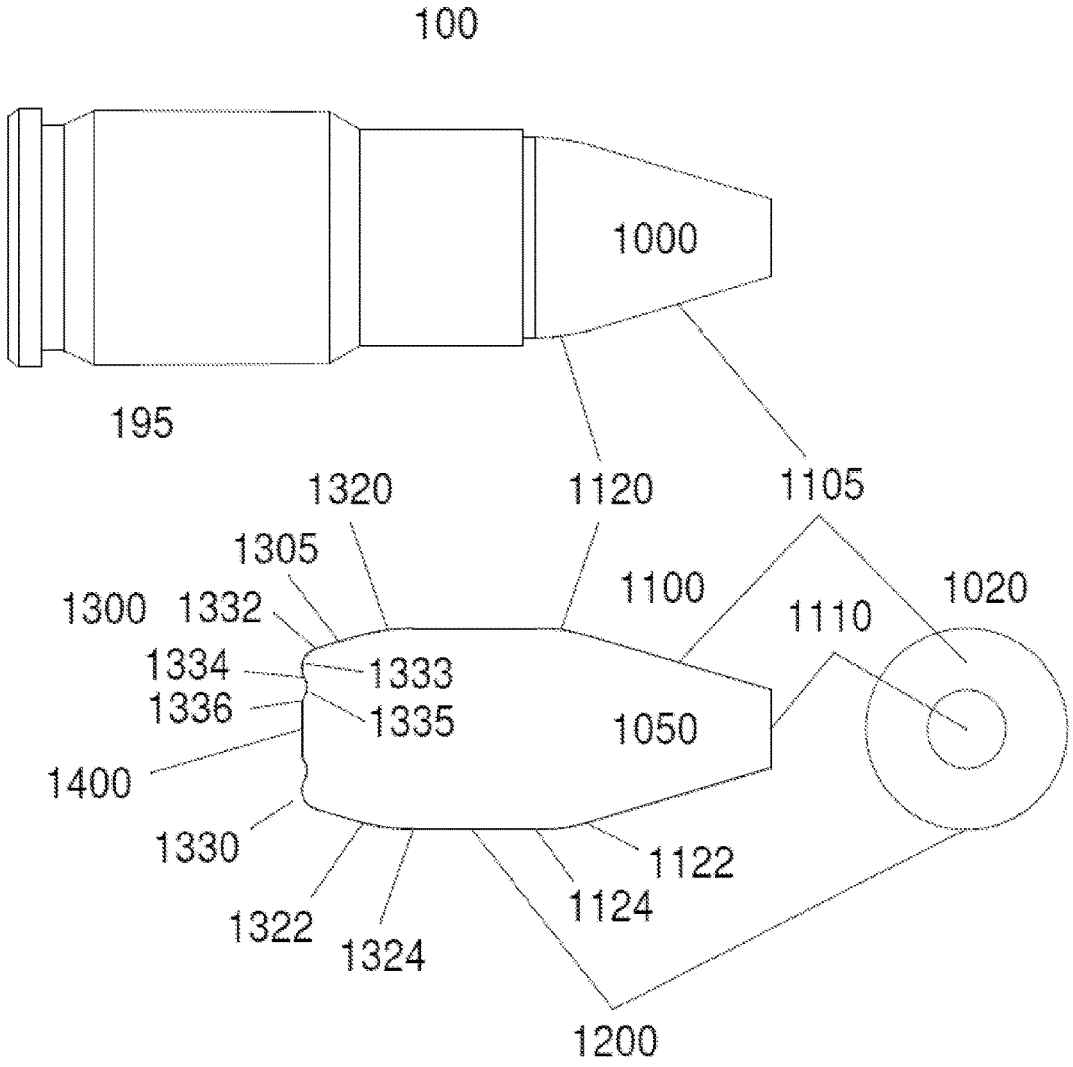
FIG. 5 depicts an assembled cartridge and a dimpled base bullet with a truncated cone, ogive, boattail and dual tangent blend radii in accordance with an embodiment of the present disclosure.

FIG. 5 depicts an assembled cartridge and a dimpled base bullet with a truncated cone ogive and dual tangent blend radii in accordance with an embodiment of the present disclosure. The improved pistol bullet includes at least one dimple formed into a base of the bullet adjacent to the boattail, the dimple adapted to effect a Coanda air flow around the base and reduce a turbulence and a drag on the bullet in flight. The improved pistol bullet additionally includes a curved segment joining the dimpled base and the boattail cone, the curved segment configured to effect a Coanda air flow across the curved segment. The improved pistol bullet further includes a truncated cone ogive with a meplat end and a shank end, the truncated cone ogive adapted to produce less drag and friction in air than a secant or a tangent ogive.

FIG. 5 details a dimpled base bullet with a truncated cone ogive and a dual tangent blend radius in accordance with an embodiment of the present disclosure. Different than common elliptical profile bullets, FIG. 5 shows Item 100 with a different bullet, Item 1000, inserted with the brass case, Item 195. Immediately below the assembled cartridge, Item 100, is a cross sectional view, Item 1050, down the major axis of the entire bullet that has been removed from the cartridge case, Item 195. Immediately to the right of Item 1050 is an end view, Item 1020, of the solid bullet, Item 1000.

The shape of the bullet ogive, Item 1100, is that of a truncated cone portion, Item 1105, in conjunction with a radius portion, Item 1120, which transitions or blends the ogive with the bearing portion or shank of bullet, Item 1200. The bearing portion of the bullet is nominally cylindrical with an outside diameter and known as the bullet caliber. In the case of the 30 SS™ (Super Short) and 30 Super™ the outside diameter of Item 1200 is 0.308". The 30 SS™ and 30 Super™ marks indicate a distinctive source of the disclosed bullets to consumers. The leading, flat portion of the truncated cone, Item 1110, is known as the meplat, a French noun which means "the flat of". The exterior surface of the conical portion, Item 1105, intersects tangent with the blend radius, Item 1120, at Item 1122. The blend radius, Item 1120, intersects tangent with the bearing portion of the bullet, Item 1200, at Item 1124.

As drawn in FIG. 5, the radius of curvature for Item 1120 is 1 caliber or 0.308". This results in the cone diameter at Item 1122 being smaller than the inside diameter of the rifle lands. For a pistol that fires 0.308" diameter bullets the grooves of the rifling are nominally 0.308" and the lands of the rifling are nominally 0.300".

Another aspect of this invention discloses a unique boattail cone, Item 1300, a tapering portion of the bullet that comes after the cylindrical bearing portion of the bullet, Item 1200. Item 1320 is the blend radius from Item 1200 to Item 1305. Item 1305 is the truncated conical portion of the boattail, Item 1300. The exterior surface of Item 1200 intersects tangent with the blend radius, Item 1320, at Item 1324. The blend radius, Item 1320, intersects tangent with Item 1305 at Item 1322. The radius of curvature and arc length of Item 1320 are the same as the radius of curvature and arc length as Item 1120, effectively mirror images of the other. Although shorter in length than Item 1105, Item 1305 has the same cone angle as Item 1105.

After the truncated cone portion, Item 1305, and prior to bullet base, Item 1400, there are various curved segments, Item 1330. The intent of curve segments, Item 1330, is to induce the Coanda effect at the back end of the bullet, Item 1000, to reduce wake turbulence, related drag and improve the ballistic efficiency while in flight. Typically, the flat base of a bullet intersects the conical portion of its boattail in a sharp angle, resulting in significant wake turbulence trailing after the bullet. The result of Item 1330 is akin to the aerodynamic benefit of dimples on a golf ball, which induce the air to more fully envelope the ball, reducing the wake turbulence and adding distance to the flight of a dimpled golf ball versus a smooth surface golf ball.

Item 1332 is the tangent intersection point of Item 1305 and the first curve segment, Item 1333. Item 1334 is the tangent intersection point of Item 1333 and the second curve segment, Item 1335. Item 1333 lies anterior or tangent to Item 1400 and has a center point within the cross sectional profile of the bullet, Item 1050. Item 1336 is the terminal intersection point of Item 1335 and Item 1400. Item 1335 lies anterior to Item 1400 and has a center point outside the cross sectional profile of the bullet, Item 1050. The first curve segment 1333 and the second curve segment 1335 form an 'S' shaped cross-section with the first curve segment 1333 forming an annular ridge and the second curve segment 1335 forming an annular trough in the bullet base 1400. A plateau center portion of the base 1400 lies in a plane intersecting the center points of the curved segments orthogonal to a central axis of the bullet.

The aerodynamic benefits of the features described in Item 1300 apply even more so to conventional rifle bullets, such as those used in the 308 Winchester/7.62×51 mm NATO cartridge. Bullets used in that cartridge are longer in overall length with greater fineness and aspect ratios and significantly higher muzzle velocities than the same 0.308" diameter bullets in the 30 SS™ and 30 Super™. Given the same ogive length, bullet diameter and meplat diameter, the truncated cone ogive with the dual tangent blend radius described herein is: (1) less blunt than tangent, secant or hybrid secant ogives resulting in less related drag due to the smaller primary shock and (2) have less surface or wetted area than tangent, secant or hybrid secant ogives resulting is less drag due to friction.

Additionally, secant ogives are not tangent the shank of the bullet at the point of intersection. Depending on the ogive length, ogive radius of curvature and fineness ratio, the non-tangent intersection of a secant ogive with the shank of the bullet can cause secondary shock waves, which is not the case with tangent ogives and truncated cone ogives with the dual tangent blend radius.

Figure 6:
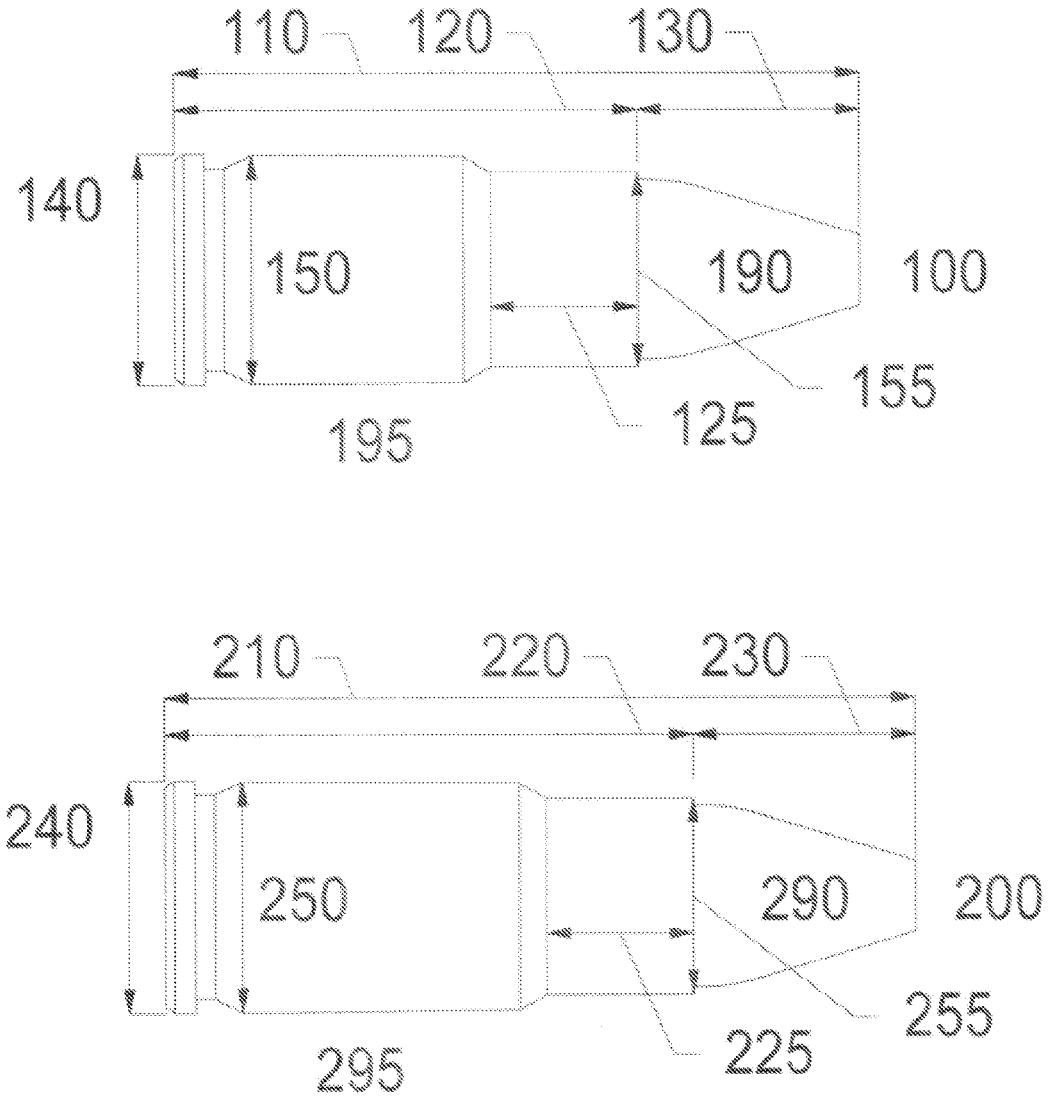
FIG. 6 depicts an improved first and an improved second pistol cartridge and respective improved pistol bullets therein in accordance with an embodiment of the present disclosure.

FIG. 6 depicts an improved first and an improved second pistol cartridge bullet in accordance with an embodiment of the present disclosure. Item 110 indicates the COAL for the 30 SS™. Item 120 indicates the Case Length for the 30 SS™. Item 125 indicates the Bottleneck Length for the 30 SS™. Item 130 indicates the Ogive Length for the 30 SS™. Item 140 indicates the Rim Diameter for the 30 SS™. Item 150 indicates the Base Diameter for the 30 SS™. Item 155 indicates the Neck Diameter for the 30 SS™. Item 190 indicates the bullet loaded in the 30 SS™. Item 195 indicates the brass case that contains the primer, gun powder (not shown) and bullet, Item 190, within. The reference numbers in the two hundred series are similarly indicated.

One aspect of this invention discloses a new cartridge with external ballistic and terminal performance superior to the 9×19 mm Luger in regular and +P and +P+ pressure designations, 40 S&W and 357 SIG, while utilizing the existing pistol magazines and requiring only a change of the barrel and recoil spring. Medium frame semi-automatic pistols in these calibers are designed for centerfire cartridges with a Cartridge Over All Length (COAL) typically less than or equal to the 9×19 mm Luger, which is 1.169". This drop-in-replacement cartridge for the 9×19 mm Luger will be derived from the 9×23 mm Winchester case that has been necked down for 30 caliber bullets (0.308" bullet diameter) and shortened to result in a COAL that is the essentially the same as 9×19 mm. The designation for this new cartridge is 7.62×20 mm and to be known as the 30 SS™.

Another aspect of this invention discloses a new 30 caliber cartridge again based on the 9×23 mm Winchester case resulting in superior external ballistic and terminal performance to the above referenced 7.62×20 mm. This cartridge will be designated as the 7.62×23 mm and to be known as the 30 Super. This cartridge is designed to be a drop-in-replacement with a new barrel and recoil spring for larger frame pistols that fire longer cartridges like the 38 Super, 10 mm Automatic, 9×23 mm Winchester and 45 ACP, which have a range of COALs from 1.26" to 1.30". The 30 Super will be derived from the 9×23 mm Winchester case that has been necked down for 30 caliber bullets (0.308" bullet diameter) and result in a nominal COAL of 1.28". The case length of the 30 Super, 0.900", will be the same as the case of the 9×23 mm Winchester. The 30 Super is essentially a longer version of the 30 SS™ with greater powder volume underneath the seated bullet.

Figure 7:
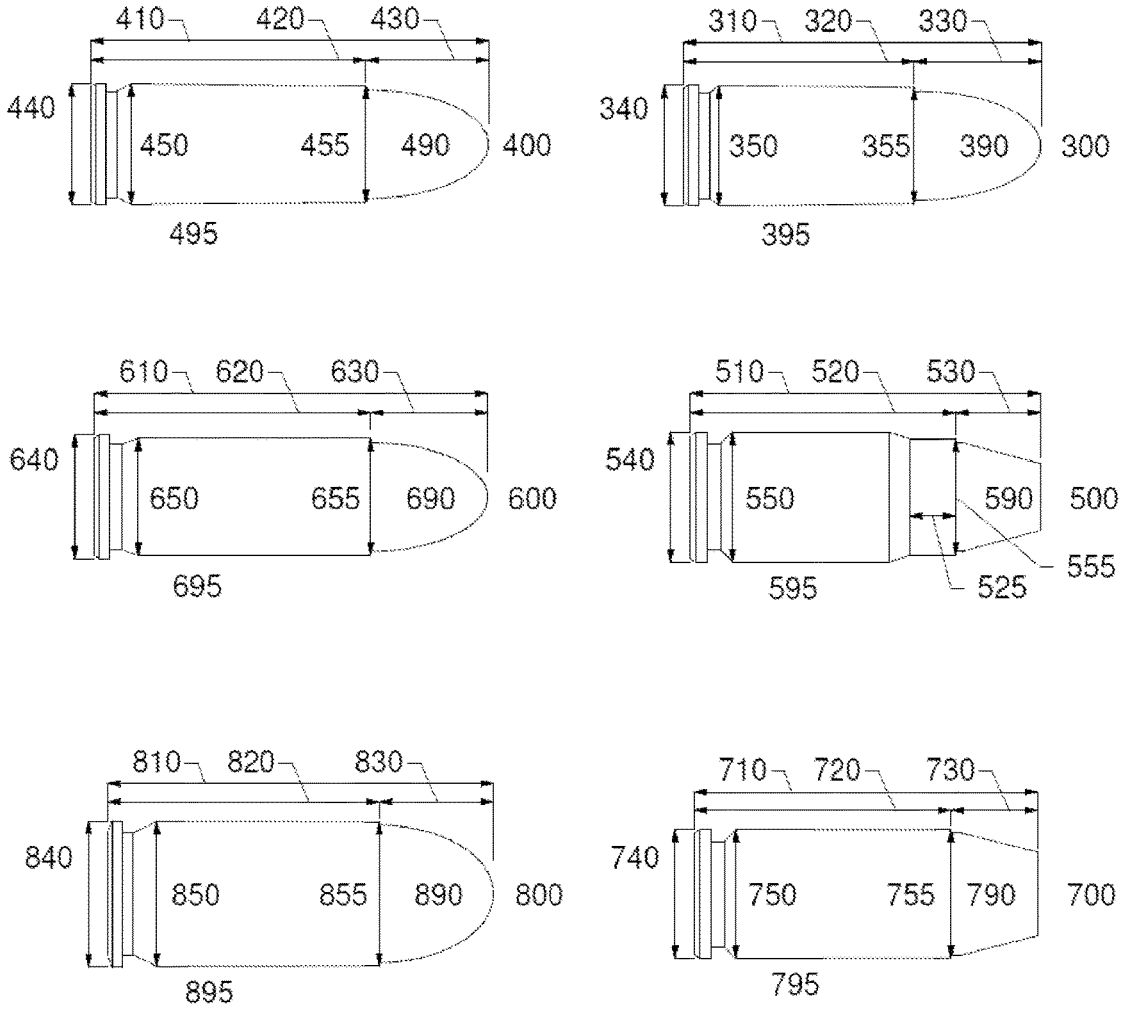
Prior Art FIG. 7
FIG. 7 illustrates two columns of various conventional medium and large pistol cartridges and bullets therein.

FIG. 7 illustrates two columns of various conventional cartridges. Item 100 depicts the 30 SS™ cartridge. Using a method of numerical identification similar to the one described above for the 30 SS™: Items 300 through 395 relate to the 9 mm Luger. Items 500 through 595 relate to the 357 SIG. Items 700 through 795 relate to the 40 S&W. Items 200 through 295 relate to the 30 Super™. Items 400 through

495 relate to the 9×23 mm Winchester. Items 600 through 695 relate to the 38 Super. Items 800 through 895 relate to the 45 ACP.

The following numbers apply to medium frame pistols:

| Cartridge: | 30 SS ™ | 9 mm Luger | 40 S&W | 357 SIG |
|---|---|---|---|---|
| Bullet Diameter | .308" | .355" | .400" | .355" |
| COAL | 1.169" | 1.169" | 1.135" | 1.140" |
| Case Length | .789" | .754" | .850" | .865" |
| Ogive Length | .380" | .415" | .285 | .275" |
| Fineness Ratio (Ogive Length/ Bullet Dia) | 1.234 | 1.169 | .713 | .775 |
| Rim Diameter | .394" | .394" | .424" | .424" |
| Base Diameter | .391" | .391" | .424" | .424" |
| Neck Diameter | .333" | .380" | .423" | .381" |
| Bottleneck Length | .25" | 0 | 0 | .15" |
| Nom. Bullet Weight (grains) | 110 | 124 | 155 | 124 |
| Nom. Bullet Length | .64" | .623" | .600" | .623" |
| Aspect Ratio (bulletlength/dia) | 2.08 | 1.75 | 1.50 | 1.75 |
| Max. Case Pressure (kpsi) | 55 | 35-38.5 | 35 | 40 |

The following numbers apply to large frame pistols:

| Cartridge: | 30 Super ™ | 9 × 23 Win | 38 Super | 45 ACP |
|---|---|---|---|---|
| Bullet Diameter | .308" | .355" | .355" | .452" |
| COAL | 1.280" | 1.300" | 1.280" | 1.275" |
| Case Length | .900" | .900" | .900" | .898" |
| Ogive Length | .380" | .400" | .380" | .377" |
| Fineness Ratio | 1.234 | 1.127 | 1.070 | .834 |
| Rim Diameter | .394" | .394" | .406" | .480" |
| Base Diameter | .391" | .391" | .384" | .476" |
| Neck Diameter | .333" | .381" | .384" | .473" |
| Bottleneck Length | .25" | 0 | 0 | 0 |
| Nom. Bullet Weight (grains) | 110 | 124 | 124 | 230 |
| Nom. Bullet Length | .64" | .623" | .623" | .64" |
| Aspect Ratio | 2.08 | 1.75 | 1.75 | 1.42 |
| Max. Case Pressure (kpsi) | 55 | 55 | 36.5 | 21-23 |

The above dimensional comparisons between the 30 SS™ and 30 Super™ versus other cartridges cited herein reveals significant dimensional and functional differences that result in superior performance by the 30 SS™ and 30 Super™. Case pressure limits obtained from Section 1—Centerfire Pistol and Revolver/SAAMI (Sporting Arms and Ammunition Manufacturers Institute) Voluntary Performance Standards.

Using the 9×23 mm Winchester case with its substantially higher allowable pressure for the bottlenecked 30 SS™ will generate higher muzzle velocity than the 9 mm Luger, 40 S&W and 357 SIG, greater penetration potential than the 9 mm, 40 S&W and 357 SIG due to the higher velocity in conjunction with the smaller cross sectional area, higher expected muzzle energy in comparison with other medium frame cartridges due to the higher allowable case pressure, flatter trajectory and extended effective range due to the higher velocity, greater fineness ratio, greater aspect ratio and smaller bullet diameter. Additionally, the longer bottle neck of the 30 SS™ versus the 357 SIG allows for wider use in pistols and submachine guns that employ direct blowback actions. With the COAL and case diameter being essentially the same as the 9 mm Luger, all of the above listed benefits can be obtained by simply retrofitting existing 9 mm Luger pistols with a new barrel and stronger recoil spring.

Similar benefits redound to the 30 Super™ in comparison to the 38 Super, 9×23 mm Winchester, 10 mm Auto and 45 ACP. The dominant cartridge used in large frame pistols is the 45 ACP. Because of its larger rim and base diameter some additional modifications, other than simply replacing the barrel and recoil spring, may be required.

The 30 Super™ and 30 SS™ are both designed with an ogive length sufficient to utilize 30 caliber bullets used in the 30 Carbine cartridge, renowned from WWII. Current 30 Carbine bullet designs include full metal jacket, soft lead round nose, jacketed hollow point and polymer tipped hollow point bullets. As was the case in WWII with the 30 Carbine, the US military uses full metal jacket projectiles for its 9 mm service pistol.

Although not a signatory to the Hague Declaration, which prohibits expanding or flattening bullets, the US uses the 9 mm Luger/NATO cartridge with full metal, copper jacketed bullets and an elliptical profile. Performance superior to the 9 mm NATO round with enhanced terminal effects, greater penetration against soft body armor, increased accuracy and increased effective range are key features sought in the Modular Handgun System.

Another aspect of this invention discloses new 30 caliber cartridges based on the 10 mm Automatic (10×25 mm) case that have been necked down for 30 caliber bullets (0.308" diameter), resulting in superior external ballistic and terminal performance. The first cartridge will be designated as the 7.62×22 mm and also known as the 30-40 Automatic™. This cartridge is designed to be a drop-in-replacement requiring only a new barrel and recoil spring for larger frame pistols that fire the 10 mm Automatic with a nominal COAL of 1.26".

The second cartridge based on the 10 mm Automatic (10×25 mm) case will be designated as the 7.62×19 mm and also known as the 30-40 AS™. This cartridge is designed to be a drop-in-replacement requiring only a new barrel and recoil spring for medium frame pistols that fire either the 40 S&W or the 357 SIG with a nominal COAL of 1.14". The 30-40 AS™ is essentially a shorter version of the 30-40 Automatic™ with less powder volume underneath the seated bullet.

Figure 8:
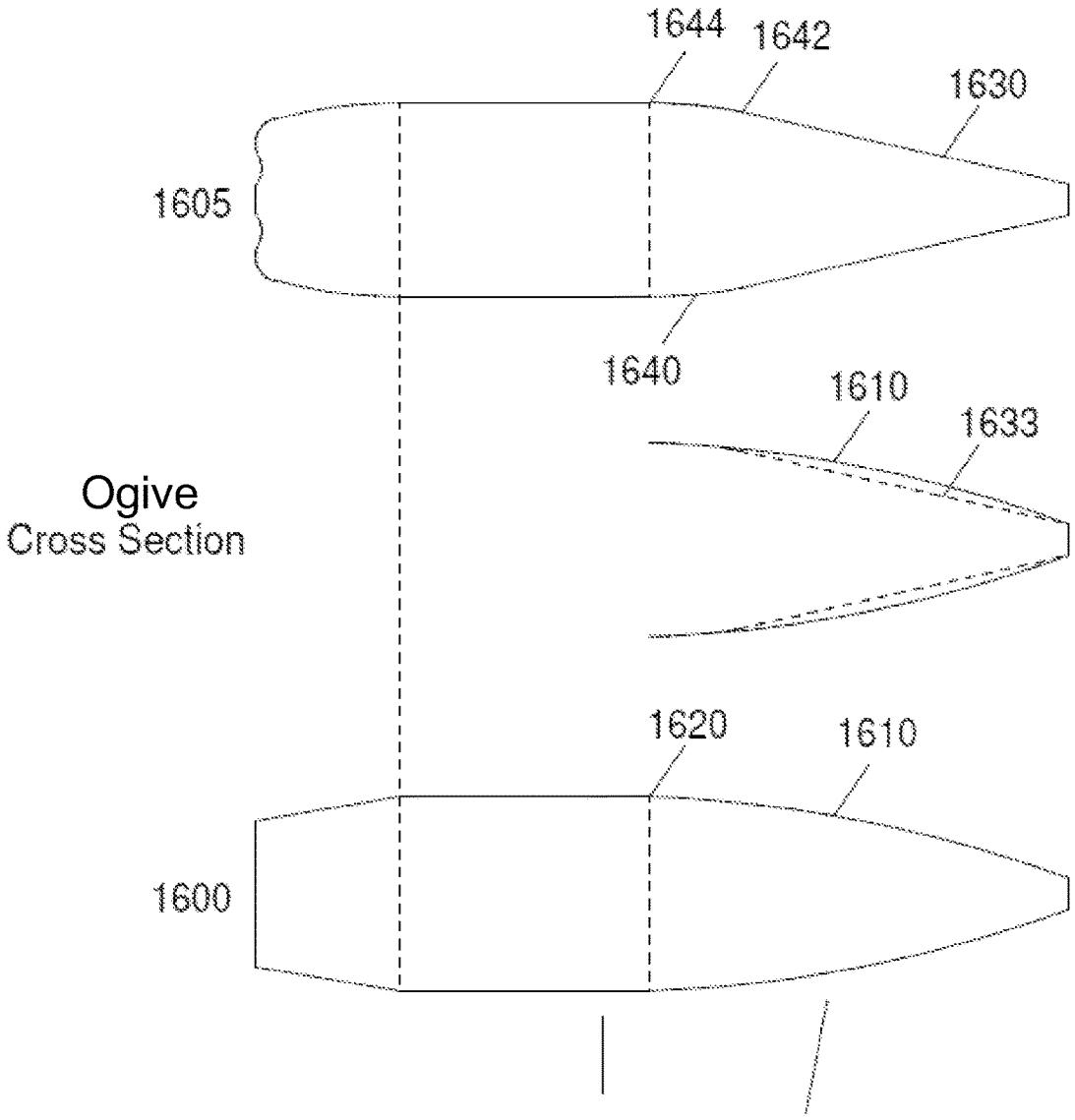
FIG. 8 depicts the shape and size benefits of a bullet with a truncated cone ogive, dual tangent blend radii and dimpled base in comparison to a secant ogive in accordance with an embodiment of the present disclosure.
Figure 9:
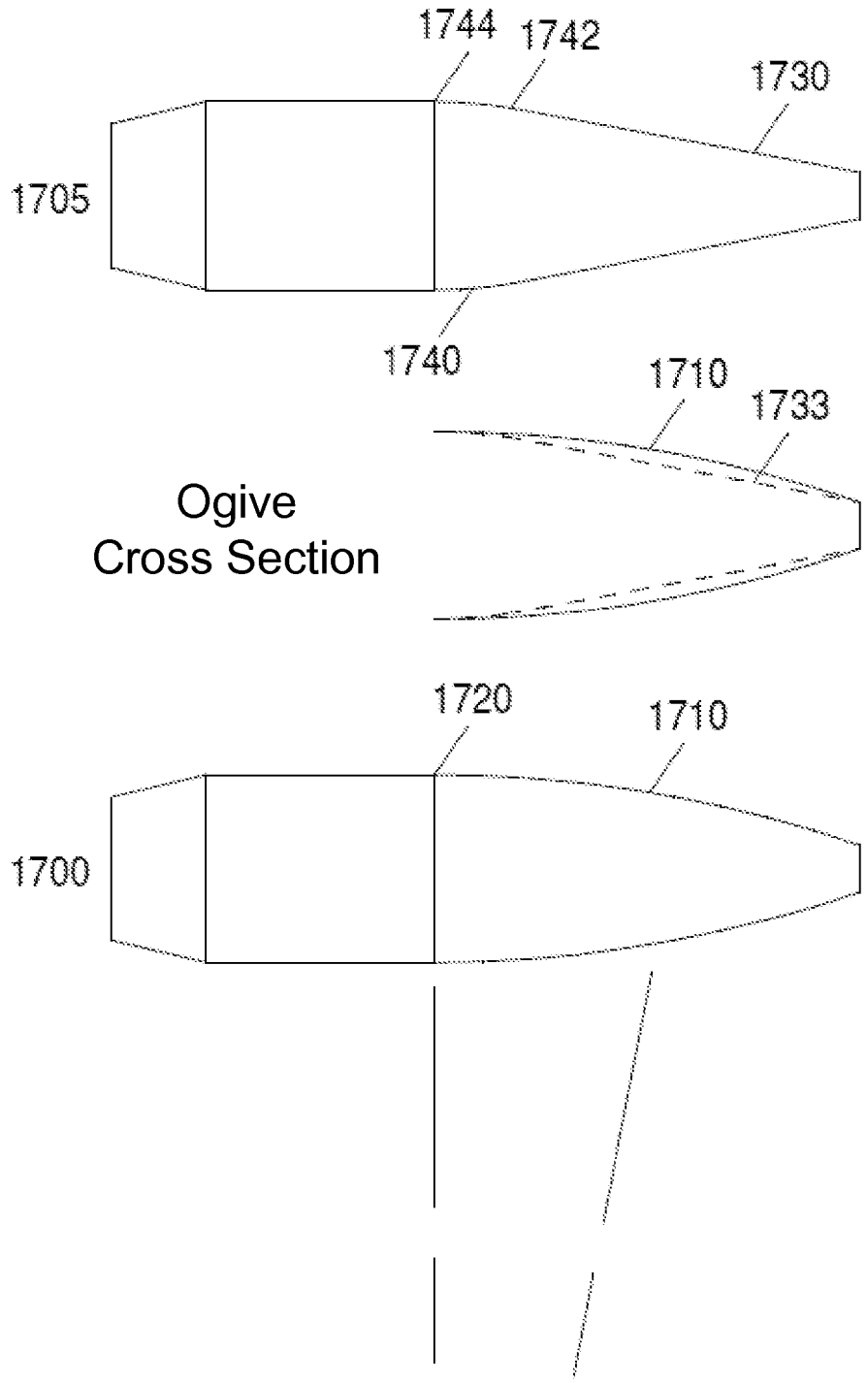
FIG. 9 depicts a second example of the shape and size benefits of an improved bullet in comparison to a tangent ogive in accordance with an embodiment of the present disclosure.

FIGS. 8 and 9 illustrate the shape and size benefits of a bullet with a truncated cone ogive and a dual tangent blend radius in comparison to a secant ogive and a tangent ogive in accordance with an embodiment of the present disclosure. The 7.62 mm (0.308") diameter conventional rifle bullet shapes found in FIG. 8 (M118 Match with secant ogive) and FIG. 9 (Sierra International M852 with tangent ogive) were obtained at pages 11 and 13 respectively from *Aerodynamic Characteristics of* 7.62 *mm Match Bullets*, December 1988 by Robert L. McCoy of the Ballistic Research Laboratory, Aberdeen Proving Grounds, Maryland.

As also drawn in FIGS. 8 and 9, the radius of curvature for Item 1640 and Item 1740 are both 2.5 caliber or 0.77". This results in the cone diameter at Item 1642 and Item 1742 both being smaller than the inside diameter of the rifle lands. For a rifle that fires 0.308" diameter bullets the grooves of the rifling are nominally 0.308" and the lands of the rifling are nominally 0.300".

Item 1600 in FIG. 8 is a profile view of the M118 Match bullet in 0.308" caliber. Item 1610 is the ogive profile. Item 1620 is the non-tangent intersection of Item 1610 with shank of the bullet, Item 1600. Item 1605 has the same ogive length, shank length and overall length as Item 1600. Item 1630, is a truncated cone with dual tangent blend radius. Item 1640 is the blend radius between the truncated cone portion and the shank of Item 1605. Item 1642 is the tangent intersection point of the truncated cone and the blend radius, Item 1640. Item 1644 is the tangent intersection point of the blend radius, Item 1640, with the shank of the bullet. Item 1633 is the same as Item 1630 but shown in dashed lines and overlaying an extracted Item 1610.

Item 1700 in FIG. 9 is a profile view of the Sierra International M852 bullet in 0.308" caliber. Item 1710 is the ogive profile. Item 1720 is the tangent intersection of Item 1710 with shank of the bullet, Item 1700. Item 1705 is the same as Item 1700 except the ogive, Item 1730, is a truncated cone with dual tangent blend radius. Item 1740 is the blend radius between the truncated cone portion and the shank of Item 1705. Item 1742 is the tangent intersection point of the truncated cone and the blend radius, Item 1740. Item 1744 is the tangent intersection point of the blend radius, Item 1740, with the shank of the bullet. Item 1733 is the same as Item 1730 but shown in dashed lines and overlaying an extracted Item 1710.

Figure 10:
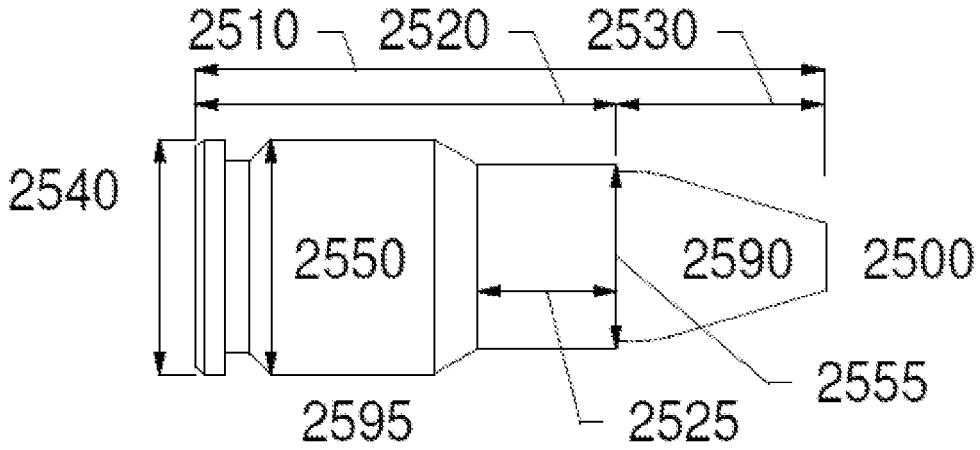
FIG. 10 depicts two exemplary pistol cartridges and respective improved pistol bullets therein in accordance with an embodiment of the present disclosure.
Figure 10:
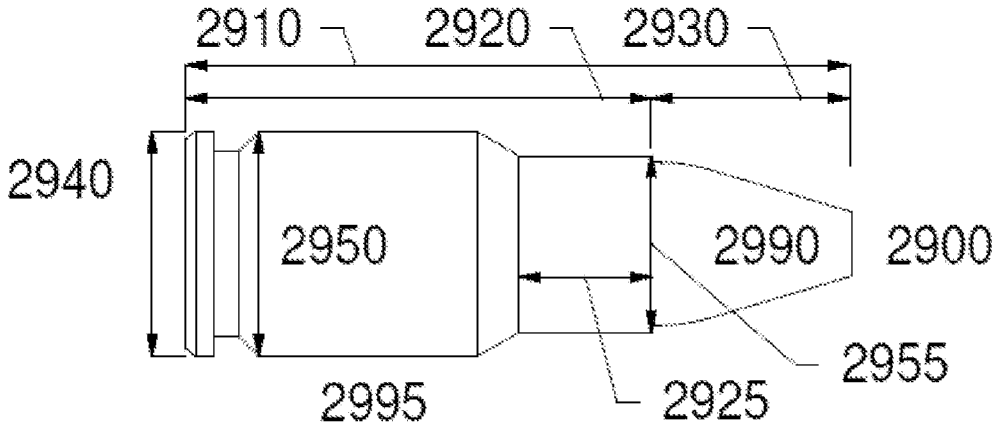

FIG. 10 depicts two exemplary pistol cartridges and respective improved pistol bullets therein in accordance with an embodiment of the present disclosure. Specific dimensions for reference numbers shown with respect to items 2500 and 2900 may be found in respective drawings of FIG. 11. Item 2500 depicts the 30-40 AS™ cartridge. Item 2510 indicates the COAL for the 30-40 AS™. Item 2520 indicates the Case Length for the 30-40 AS™. Item 2525 indicates the Bottleneck Length for the 30-40 AS™. Item 2530 indicates the Ogive Length for the 30-40 AS™. Item 2540 indicates the Rim Diameter for the 30-40 AS™. Item 2550 indicates the Base Diameter for the 30-40 AS™. Item 2555 indicates the Neck Diameter for the 30-40 AS™. Item 2590 indicates the bullet loaded in the 30-40 AS™. Item 2595 indicates the brass case that contains the primer, gun powder (not shown) and bullet, Item 2590, within.

Using a method of identification similar to the one described above for the 30-40 AS™: Items 500 through 595 relate to the 357 SIG. Items 700 through 795 relate to the 40 S&W. Items 2900 through 2995 relate to the 30-40 Automatic™. Items 900 through 995 relate to the 10 mm Automatic.

The following numbers apply to Medium Frame Pistols:

| Cartridge: | 30-40 AS | 40 S&W | 357 SIG |
|---|---|---|---|
| Bullet Diameter | .308" | .400" | .355" |
| COAL | 1.140" | 1.135" | 1.140" |
| Case Length | .760" | .850" | .865" |
| Ogive Length | .380" | .285 | .275" |
| Fineness Ratio | 1.234 | .713 | .775 |
| Rim Diameter | .424" | .424" | .424" |
| Base Diameter | .424" | .424" | .424" |
| Neck Diameter | .333" | .423" | .381" |
| Bottleneck Length | .25" | 0 | .15" |
| Nominal Bullet Weight (grains) | 110 | 155 | 124 |
| Nominal Bullet Length | .64" | .600" | .623" |
| Aspect Ratio | 2.08 | 1.50 | 1.75 |
| Max. Case Pressure (kpsi) | 40 | 35 | 40 |

The following numbers apply to Large Frame Pistols:

| Cartridge: | 30-40 Auto | 10 mm Auto |
|---|---|---|
| Bullet Diameter | .308" | .400" |
| COAL | 1.260" | 1.260" |
| Case Length | .880" | .992" |
| Ogive Length | .380" | .268" |

-continued

| Cartridge: | 30-40 Auto | 10 mm Auto |
|---|---|---|
| Fineness Ratio | 1.234 | .670 |
| Rim Diameter | .424" | .424" |
| Base Diameter | .424" | .424" |
| Neck Diameter | .333" | .423" |
| Bottleneck Length | .25" | 0 |
| Nominal Bullet Weight (grains) | 110 | 180 |
| Nominal Bullet Length | .64" | .660" |
| Aspect Ratio | 2.08 | 1.65 |
| Max. Case Pressure (kpsi) | 40 | 37.5 |

The above dimensional comparisons between the 30-40 AS™ and 30-40 Automatic™ versus other cartridges based on the 10 mm Automatic case reveal significant dimensional and functional differences that result in superior performance by the 30-40 AS™ and 30-40 Automatic™. The 0.394" rim diameter of the 9×23 mm Winchester case is sufficiently different than the 0.424" rim diameter of 10 mm Automatic case as to cause new cartridge feeding and spent cartridge extraction problems, if the 30 Super™/30 SS™ cartridges were retrofitted for use in weapons designed for 10 mm Automatic, 40 S&W and 357 Sig cartridges. Otherwise, many of the ballistic and functional benefits of the 30 Super™/30 SS™ cartridges will be evident in 30-40 Automatic/30-40 AS cartridges as well.

Figure 11:
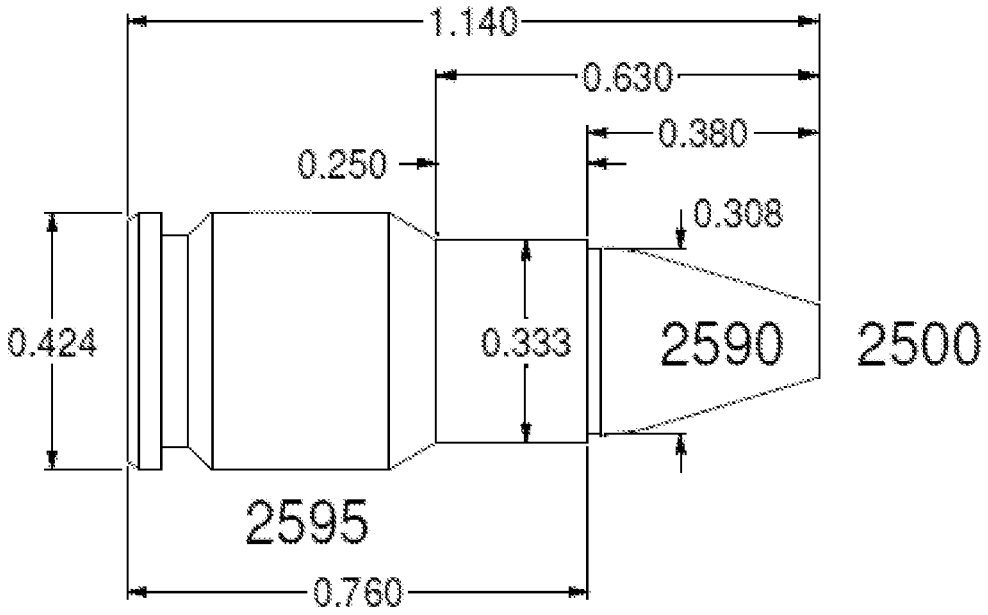
FIG. 11 depicts the dimensions of 2 exemplary pistol cartridges and respective pistol bullets therein in accordance with an embodiment of the present disclosure.
Figure 11:
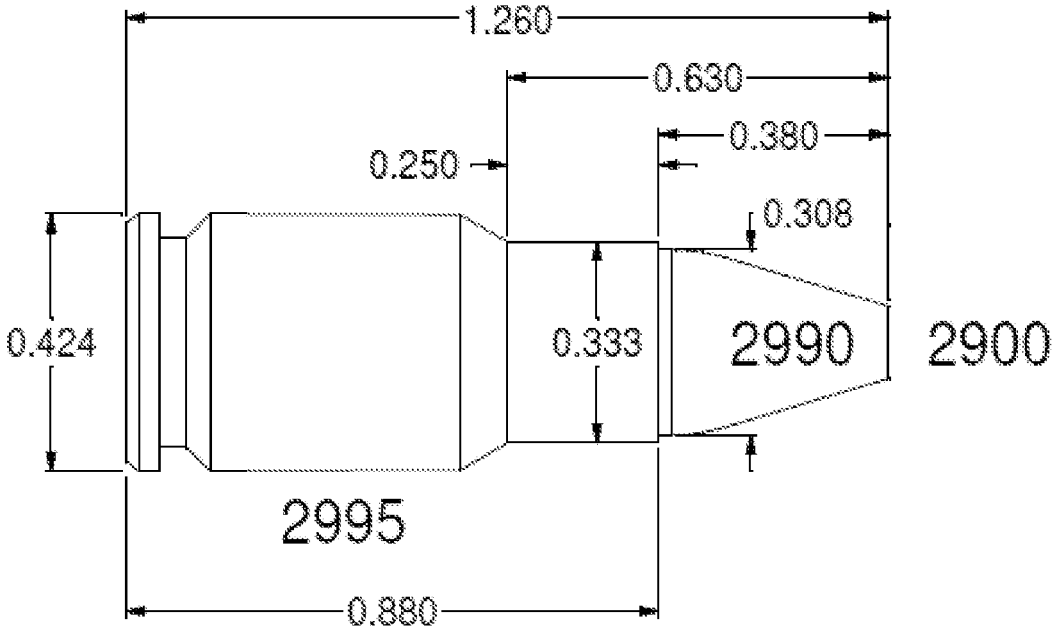

FIG. 11 depicts the specific dimensions of 2 exemplary pistol cartridges and respective pistol bullets therein in accordance with an embodiment of the present disclosure. Dimensions shown are in inches. Some reference numbers shown are the same or similar to reference numbers used in FIG. 10 and elsewhere herein.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. An improved bullet comprising:

a dual tangent blend radius disposed between a first tangent thereof intersecting a shank of the bullet and a second tangent thereof intersecting one of a cone ogive and a boattail of the bullet;

a first curve segment on a base of the bullet, the first curve segment comprising a convex center point within a base profile of the bullet and forms an annular ridge therein;

a second curve segment on the base of the bullet, the second curve segment comprising a concave center point outside the base profile of the bullet and forms an annular trough therein, wherein the first curve segment and the second curve segment form an 'S' shaped cross-section on the bullet base configured to extend an effective flight range and a Coanda effect there around reducing air turbulence and drag on the bullet in flight; and a plateau center portion of the base of the bullet lies in a plane intersecting the center points of the curved segments and orthogonal to a central axis of the bullet.

2. The improved bullet of claim 1, further comprising a plurality of annular dimples formed into a base of the bullet adjacent the boattail ogive, the dimples configured to effect a Coanda air flow around the base and reduce a turbulence and a drag on the bullet in flight.

3. The improved bullet of claim 1, further comprising a plurality of curved segments configured to join the bullet base and the boattail, the curved segments configured to effect a Coanda air flow across the curved segments.

4. The improved bullet of claim 1, further comprising a truncated cone ogive with a meplat end and a shank end, the truncated cone ogive configured to produce less drag and friction in air than a secant or a tangent ogive.

5. The improved bullet of claim 1, wherein the dual tangent blend radius is equal to or larger than a radius of the shank of the improved pistol bullet.

6. The improved bullet of claim 1, wherein a radius of curvature and an arc length of a first dual tangent blend radius between the cone ogive and the shank and a second dual tangent blend radius between the boattail cone and the shank are substantially the same.

7. The improved bullet of claim 1, wherein a length of the boattail cone is shorter than a length of the cone ogive but the respective dual tangent blend radii being mirror images of each other.

8. The improved bullet of claim 1, wherein a fineness ratio of the ogive cone length to a diameter of the bullet is larger than 1.20 plus or minus a ten percent manufacturing tolerance.

9. The improved bullet of claim 1, wherein an aspect ratio of a length of the bullet to a diameter thereof is larger than 1.75 plus or minus a ten percent manufacturing tolerance.

10. The improved bullet of claim 1, wherein a ratio of a concavity of the second curved segment to a convexity of the first curved segment is approximately one to one.

11. The improved bullet of claim 1, wherein a ratio of a length of a boattail cone to a length of the shank is approximately one to two.

12. The improved bullet of claim 1, wherein a ratio of a length of a boattail cone to a length of the cone ogive is approximately one to three.

13. The improved bullet of claim 1, wherein a ratio of a length of the boattail to a length of the shank of the bullet is approximately one to two.

14. The improved bullet of claim 4, wherein a ratio of a diameter of the meplat end of the truncated cone to a length of the truncated cone of the bullet is approximately 1.0 to 2.5.

* * * * *